US009248888B2

(12) United States Patent
Chiu

(10) Patent No.: US 9,248,888 B2
(45) Date of Patent: Feb. 2, 2016

(54) INFANT RECREATIONAL FLOATATION DEVICE

(71) Applicant: Tiffany An-Ting Chiu, San Francisco, CA (US)

(72) Inventor: Tiffany An-Ting Chiu, San Francisco, CA (US)

( * ) Notice: Subject to any disclaimer, the term of this patent is extended or adjusted under 35 U.S.C. 154(b) by 0 days.

(21) Appl. No.: 14/041,846

(22) Filed: Sep. 30, 2013

(65) Prior Publication Data

US 2014/0179183 A1 Jun. 26, 2014

Related U.S. Application Data

(60) Provisional application No. 61/707,418, filed on Sep. 28, 2012, provisional application No. 61/800,946, filed on Mar. 15, 2013.

(51) Int. Cl.
*B63B 35/76* (2006.01)

(52) U.S. Cl.
CPC ..... *B63B 35/76* (2013.01)

(58) Field of Classification Search
CPC ..... B63C 2009/133; B63C 9/155
USPC ..... 441/81, 109–113, 108, 122, 123; D21/803–805
See application file for complete search history.

(56) References Cited

U.S. PATENT DOCUMENTS

| | | | | | |
|---|---|---|---|---|---|
| 1,043,367 | A | * | 11/1912 | Smack | 441/123 |
| 4,263,686 | A | * | 4/1981 | Jarvis, Jr. | 441/116 |
| 5,779,512 | A | * | 7/1998 | Rupert | 441/123 |
| 6,126,504 | A | | 10/2000 | Day | |
| 6,948,991 | B2 | | 9/2005 | Zhao | |
| D703,285 | S | * | 4/2014 | Chiu | D21/803 |

* cited by examiner

*Primary Examiner* — Edwin Swinehart
(74) *Attorney, Agent, or Firm* — Byrne Poh LLP

(57) ABSTRACT

An infant recreational floatation device is provided. In some embodiments, a floatation device for an infant is provided, the floatation device comprising an inflatable ring having a top surface and a bottom surface, wherein the inflatable ring includes: an air chamber having an upper chamber portion and a lower chamber portion that are divided by a layer; a cut through the air chamber of the inflatable ring that forms a first end of the inflatable ring and a second end of the inflatable ring, wherein the first end and the second end of the inflatable ring are displaced to insert a neck of the infant into an interior space; a plurality of cut-out portions adjacent to the interior space; and a plurality of fasteners placed on the top surface and the bottom surface of the inflatable ring that detachably connect the first end and the second end of the inflatable ring.

18 Claims, 7 Drawing Sheets

INFANT RECREATIONAL FLOATATION DEVICE

CROSS REFERENCE TO RELATED APPLICATIONS

This application claims the benefit of U.S. Provisional Patent Application No. 61/707,418, filed Sep. 28, 2012, and U.S. Provisional Patent Application No. 61/800,946, filed Mar. 15, 2013, which are hereby incorporated by reference herein in their entireties.

TECHNICAL FIELD

In accordance with various embodiments of the disclosed subject matter, an infant recreational flotation device is provided. More particularly, the disclosed subject matter relates to a swim ring for an infant such that the infant can exercise in a body of water, such as a pool, prior to and after developing neck strength and/or head control.

BACKGROUND

A swim ring is generally a donut-shaped inflatable tube that is made of a flexible plastic material. To achieve this shape, the swim ring generally includes two identically-sized circular layers of plastic, where an inner concentric circle of plastic has been removed and where the inner and outer edges are joined to form an air chamber. The swim ring also includes a valve that allows the air chamber of the swim ring to be inflated with air. Once inflated, the swim ring can, for example, be placed around the torso of the user.

For infants, swim rings are made that can be placed around the neck of an infant. Such swim rings for infants, however, have a number of disadvantages. For example, when placing the swim ring around the neck of an infant, the caregiver is generally required to forcibly create an opening at cut ends of the swim ring, which can be extremely rigid when the swim ring is fully inflated. This procedure of forcibly creating an opening so that the swim ring can be placed around the neck of the infant can be uncomfortable for both the caregiver and the infant. Moreover, additional force is generally needed to create a wider opening to accommodate a larger neck circumference.

There is therefore a need in the art for a new infant recreational floatation device. Accordingly, it is desirable to provide an infant recreational floatation device that overcomes these and other deficiencies of the prior art.

SUMMARY

In accordance with various embodiments of the disclosed subject matter, an infant recreational floatation device is provided.

In some embodiments of the disclosed subject matter, a floatation device for an infant is provided. The floatation device includes an inflatable ring having a top surface and a bottom surface, wherein the inflatable ring includes: an air chamber having an upper chamber portion and a lower chamber portion that are divided by a layer; a cut through the air chamber of the inflatable ring that forms a first end of the inflatable ring and a second end of the inflatable ring, wherein the first end and the second end of the inflatable ring are displaced to insert a neck of the infant into an interior space; a plurality of cut-out portions adjacent to the interior space; and a plurality of fasteners placed on the top surface and the bottom surface of the inflatable ring that detachably connect the first end and the second end of the inflatable ring.

In some embodiments, upon inflating the inflatable ring and connecting the first fastener and the second fastener to connect the first end and the second end of the inflatable ring, the flotation ring is substantially toroid-shaped.

In some embodiments, each of the first end and the second end of the inflatable ring is displaced within at least a portion of one of the plurality of cut-out portions.

In some embodiments, the plurality of cut-out portions are circular and a first cut-out portion of the plurality of cut-out portions is adjacent to the first end of the inflatable ring and a second cut-out portion of the plurality of cut-out portions is adjacent to the second end of the inflatable ring.

In some embodiments, upon inflating the inflatable ring and connecting the first fastener and the second fastener to connect the first end and the second end of the inflatable ring, the plurality of cut-out portions are not connected to the interior space.

In some embodiments, upon inflating the inflatable ring and displacing the first end and the second end of the inflatable ring, the plurality of cut-out portions are connected to the interior space based on a neck circumference of the infant.

In some embodiments, the inflatable ring further includes an inner ring portion that is in communication with the upper chamber portion of the air chamber.

In some embodiments, the inner ring portion is substantially half-toroid-shaped.

In some embodiments, a portion of the inner ring portion is used form a chin rest for the infant.

In some embodiments, the inflatable ring further includes a plurality of balls placed within the upper chamber portion of the air chamber.

In some embodiments, the inflatable ring further includes a plurality of handles formed on the top surface of the inflatable ring.

In some embodiments, the inflatable ring further includes at least a first valve on the top surface of the inflatable ring connected to the upper chamber portion of the air chamber and at least a second valve on the bottom surface of the inflatable ring connected to the lower chamber portion of the air chamber.

In some embodiments, the upper chamber portion and the lower chamber portion of the air chamber are not in fluid communication.

In some embodiments of the disclosed subject matter, a floatation device is provided that includes an inflatable ring having an interior space formed in a center region of the inflatable ring, wherein the inflatable ring includes: an air chamber; a plurality of cut-out portions that are adjacent to the interior space; a cut through the air chamber of the inflatable ring that forms opposing ends of the inflatable ring; and a plurality of fasteners that detachably connect the opposing ends of the inflatable ring.

In some embodiments, each of the opposing ends is substantially flat and where the substantially flat opposing ends are connected to form the inflatable ring having a toroid shape.

In some embodiments, each of the opposing ends is displaced within at least a portion of one of the plurality of cut-out portions.

In some embodiments, the plurality of cut-out portions are circular and wherein each of the plurality of cut-out portions is adjacent to one of the opposing ends of the inflatable ring.

In some embodiments, the inflatable ring further comprises an inner ring portion that is in communication with the air chamber, wherein the inner ring portion is substantially half-toroid-shaped.

In some embodiments, a chin rest for the infant is formed on a surface of the inner ring portion.

In some embodiments of the disclosed subject matter, a floatation device is provided, the floatation device including an inflatable ring having an interior space formed in a center region of the inflatable ring, wherein the inflatable ring includes: a toroid-shaped air chamber that includes a cut through a cross-section of the air chamber, wherein the cut forms opposing ends of the toroid-shaped air chamber; a plurality of cut-out portions, wherein each of the plurality of cut-out portions is adjacent to the interior space and one of the opposing ends of the toroid-shaped air chamber; and a plurality of fasteners that detachably connect the opposing ends of the inflatable ring.

BRIEF DESCRIPTION OF THE DRAWINGS

Various objects, features, and advantages of the disclosed subject matter can be more fully appreciated with reference to the following detailed description of the invention when considered in connection with the following drawing, in which like reference numerals identify like elements.

DETAILED DESCRIPTION

Figure 1:
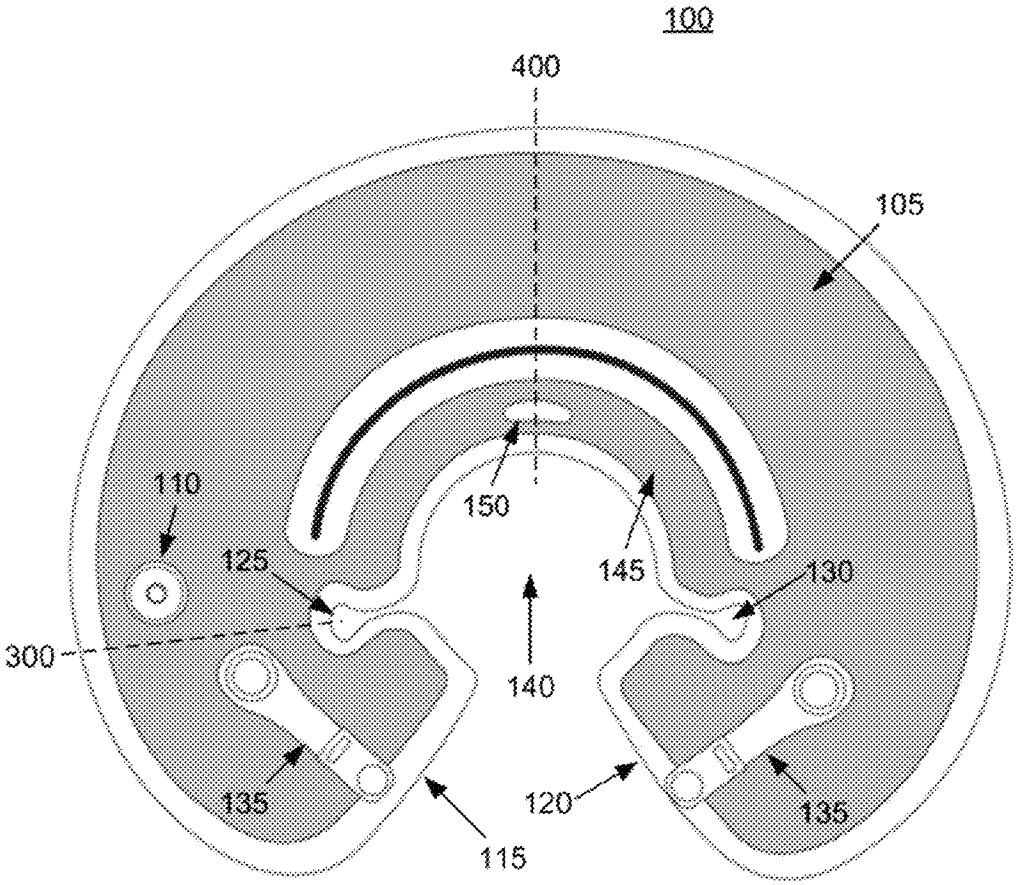
FIG. 1 is an illustrative example of an infant recreational floatation device, where the chamber has not been inflated with air, in accordance with some embodiments of the disclosed subject matter.

In accordance with various embodiments of the disclosed subject matter, an infant recreational floatation device is provided.

Generally speaking, the infant recreational floatation device includes an inflatable ring having a top surface and a bottom surface. The inflatable ring can include a chamber that forms a central opening, where the neck of the infant can be placed when using the infant recreational floatation device. The chamber can be constructed and/or cut such that opposing ends of the chamber are formed. The opposing ends of the chamber can be displaced (e.g., in a horizontal direction) such that the infant recreational floatation device, when inflated, can be placed around the neck of an infant.

In addition, the chamber can also include multiple cut-out portions formed on the inner edge of the chamber that are each adjacent to one of the opposing ends. These multiple cut-out portions can, for example, facilitate a caregiver in placing the neck of an infant into the central opening of the infant recreational floatation device when the chamber of the device has been inflated with air (e.g., as the opposing ends can be displaced horizontally with the assistance of the multiple-cut out portions), facilitate a caregiver in the continued use of the infant recreational floatation device as the neck circumference of the infant continues to increase (e.g., as the multiple-cut out portions can facilitate the accommodation of increasing neck circumferences), and/or facilitate the drainage of water on the top surface of the infant recreational floatation device (e.g., as the infant splashes water onto the infant recreational floatation device during use).

When inflated, the inflatable ring can be substantially annular-shaped, ring-shaped, donut-shaped, or toroid-shaped. In some embodiments, one or more fasteners can be provided to removably connect the opposing ends of the chamber. This can, for example, allow the inflatable ring to further achieve an annular or toroid shape.

These and other features of the infant recreational floatation device are further described in connection with FIGS. 1-8.

It should be noted that the infant recreational floatation device can be used in a variety of applications. For example, the infant recreational floatation device can be placed around the neck of an infant to allow the infant to move his or her arms and legs in an unrestricted manner in a body of water (e.g., a swimming pool). In this example, an infant can use the infant recreational floatation device to learn to swim or perform swimming motions in a swimming pool prior to being able to walk or crawl. Moreover, the infant recreational floatation device can be used to allow the infant to exercise and, more particularly, to perform physical therapy exercises (e.g., when the infant does not yet possess adequate neck strength and/or head control for performing such exercises). In another example, the infant recreational floatation device can allow a caregiver to safely and comfortably place an infant into the central opening of the infant recreational floatation device when the chamber of the device has been inflated with air as opposing ends can be displaced horizontally with the assistance of the multiple-cut out portions (e.g., as opposed to displacement in the vertical direction that can contact the face or other parts of the infant).

It should also be noted that, although the embodiments of the floatation device are described in connection with the placement of the floatation device around the neck of an infant to allow the infant to move his or her arms and legs in an unrestricted manner in a body of water, this is illustrative. The floatation device can be made for use with older children and/or adults. For example, the floatation device can be enlarged to provide a larger central opening such that it can accommodate the neck circumference of an adult, such as an elderly patient. This can, for example, allow the floatation device to be used in hydrotherapy to help children and/or adults regain muscle strength in, among other things, muscles in their arms and legs. Alternatively, the floatation device and, in particular, the central opening can be modified to accommodate the neck or other body part of animals, such as a dog or a cat.

Turning to FIG. 1, an infant recreational floatation device 100 in accordance with the various embodiments of the disclosed subject matter is shown. As shown in FIG. 1, infant recreational floatation device 100 can include a chamber 105. Chamber 105 can be inflated with air or any other suitable gas using a valve 110. Valve 110 can be any suitable valve that allows a user, such as a caregiver, to inflate or deflate infant recreational floatation device 100.

Figure 5:
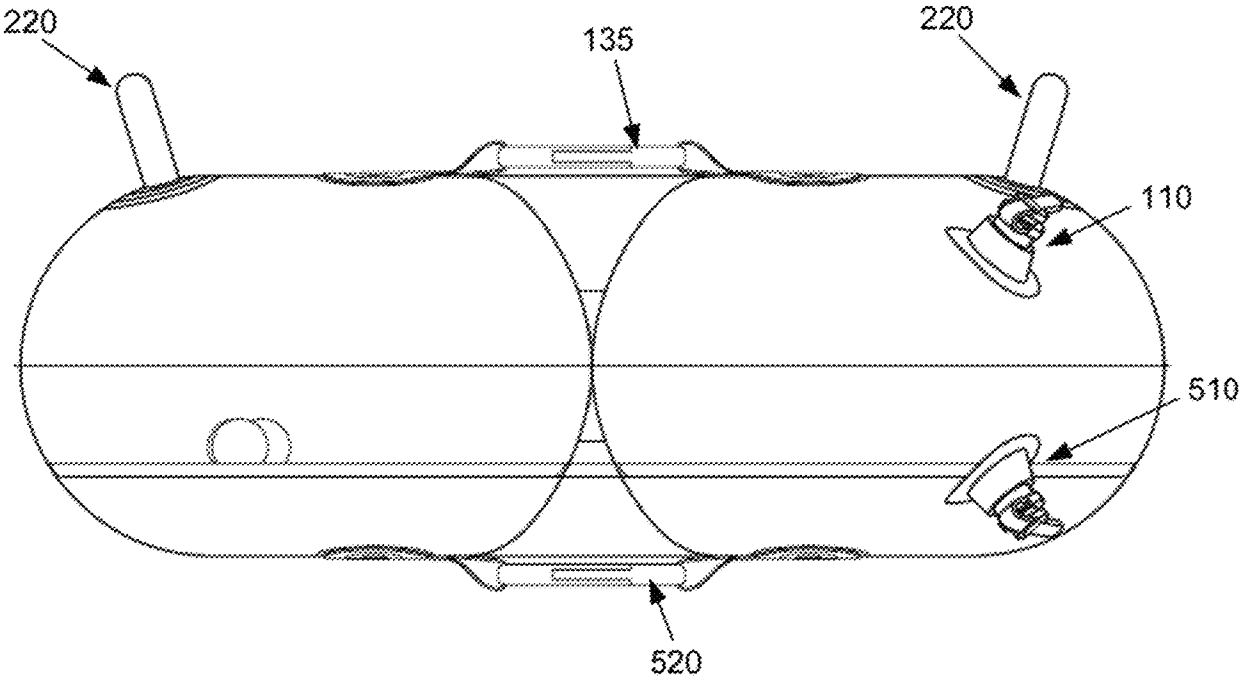
FIG. 5 is an illustrative view of an end of the infant recreational floatation device, where the chamber has been inflated with air, in accordance with some embodiments of the disclosed subject matter.

It should be noted that, although only one valve 110 is shown in FIG. 1, this is merely illustrative. Any suitable number of valves for inflating and/or deflating the infant recreational floatation device can be provided. In one suitable embodiment, multiple valves connected to chamber 105 can be placed on the top surface of the infant recreational floatation device 100. In another suitable embodiment, as described herein, multiple valves can be provided, where one valve is connected to an upper chamber portion of chamber 105 and positioned on the top surface of the infant recreational floatation device 100 and another valve is connected to a lower chamber portion of chamber 105 and positioned on the bottom surface of the infant recreational floatation device 100. For example, FIG. 1 shows that infant recreational floatation device 100 includes valve 110 on the top surface of the floatation device and FIG. 5 shows that infant recreational floatation device 100 also includes valve 510 on the bottom surface of the floatation device.

In some embodiments, valve 110 can be a one-way valve that allows the intake of air or any other suitable gas, but inhibits the expulsion of air or any other suitable gas from chamber 105 until purposefully released (e.g., using a release mechanism for releasing air from chamber 105). This can, for example, inhibit the release of air from chamber 105 via valve 110.

In some embodiments, a first end 115 and a second end 120 of chamber 105 can be formed by a cut made through chamber 105. For example, as shown in FIG. 1, which is an illustrative example of infant recreational floatation device 100 that has not been inflated with air, an appropriate portion can be removed from a ring-shaped piece of plastic (or any other suitable material) to create first end 115 and second end 120 of chamber 105. It should also be noted that at least two layers of the ring-shaped piece of plastic having the appropriate portion removed can be joined together to create chamber 105. For example, the layers of plastic can be joined together at their outer and inner edges using a high frequency plastic welding machine.

In some embodiments, cut-out portions can be formed on the inner edge of chamber 105. As shown in FIG. 1, opposing circular cut-out portions 125 and 130 can be formed on the inner edge of chamber 105. It should be noted that cut-out portion 125 can be positioned such that it is adjacent to first end 115 and cut-out portion 130 can be positioned such that it is adjacent to second end 120. It should also be noted that the positioning of cut-out portions 125 and 130 can allow first end 115 and second end 120 to be displaced by a greater degree or wider range. It should further be noted that, when chamber 105 of infant recreational floatation device 100 has been inflated, at least a portion of first end 115 can be displaced within cut-out portion 125 and at least a portion of second end 120 can be displaced within cut-out portion 130. Accordingly, the inclusion of cut-out portions 125 and 130 can, for example, alleviate the tension created when a caregiver (e.g., a parent) pries open first end 115 and second end 120 such that chamber 105 can be positioned around the neck of the infant.

Although the embodiments described herein generally show two opposing cut-out portions, this is merely illustrative. Any suitable number of cut-out portions can be provided. For example, four cut-out portions can be provided on the inner edge of chamber 105. The placement of such cut-out portions can be based, for example, on balancing the center of gravity when an infant is placed in infant recreational floatation device 100, accommodating a greater neck circumference of an infant, etc.

In addition, although the embodiments described herein generally show circular cut-output portions, this is merely illustrative. The cut-output portions, such as cut-out portions 125 and/or 130 can be any suitable shape (e.g., oval-shaped, teardrop-shaped, rectangular-shaped, etc.).

Alternatively, in some embodiments, a single cut-out portion can be provided. For example, the cut-out portion and the chin rest (described herein) can be combined and placed at the same location on the infant recreational floatation device. In another example, the infant recreational floatation device can include a single chin rest and a single cut-out portion at different locations on the infant recreational floatation device. In this example, the single cut-out portion can be formed on the inner edge of the infant recreational floatation device to facilitate the opening of the infant recreational floatation device and accommodate varying neck circumferences that may be placed in the infant recreational floatation device. The chin rest can be formed at a different location on the infant recreational floatation device to align the infant on the infant recreational floatation device, while shifting the center of gravity in a direction forward from the chin rest. The placement of the chin rest and the placement of the chin of the infant on the chin rest can shift the center of gravity of the infant recreational flotation device away from the central opening of the infant recreational floatation device to a position in which the center of gravity is located in a direction towards the chin rest. This can, for example, inhibit and/or minimize the amount of water that can enter the top surface of the infant recreational floatation device through the one or more cut-out portions.

In some embodiments, cut-out portions 125 and 130 along with other elements of infant recreational floatation device 100 (e.g., an inner tube portion) can allow portions of infant recreational floatation device 100 to be displaced. For example, cut-out portions 125 and/or 130 can allow portions of infant recreational floatation device 100 to be displaced in a horizontal direction as opposed to a vertical direction that can contact the face of the infant. As an infant grows, the circumference of the neck of the infant tends to increase. Cut-out portions 125 and 130 can allow portions of infant recreational floatation device 100 to spread to conform to the neck as its circumference increases. More particularly, when inflated and unused, cut-out portions 125 and 130 may not be connected to central opening 140, but, when placing the neck of an infant into infant recreational floatation device 100 and spreading portions of infant recreational floatation device 100 to conform to the neck, a space connecting cut-out portions 125 and 130 and central opening 140 can be created. For example, portions of infant recreational floatation device 100 can be spread to accommodate the neck of an infant having a neck circumference that is greater than a particular threshold value (e.g., the circumference of central opening 140). By accommodating for different neck circumferences, this can, for example, provide a comfortable fitting for different infants and allow an infant to continue to use infant recreational floatation device 100 as the infant grows.

In some embodiments, when using infant recreational floatation device 100 on an infant, cut-out portions 125 and 130 can allow water to drain from the surface of infant recreational floatation device 100. For example, when an infant is wearing infant recreational floatation device 100 around his or her neck and splashes water onto infant recreational floatation device 100, water that lands on the surface of infant recreational floatation device 100 (e.g., an inner tube portion) can escape through cut-out portions 125 and/or 130 (e.g., as opposed to pooling on the surface).

Figure 2:
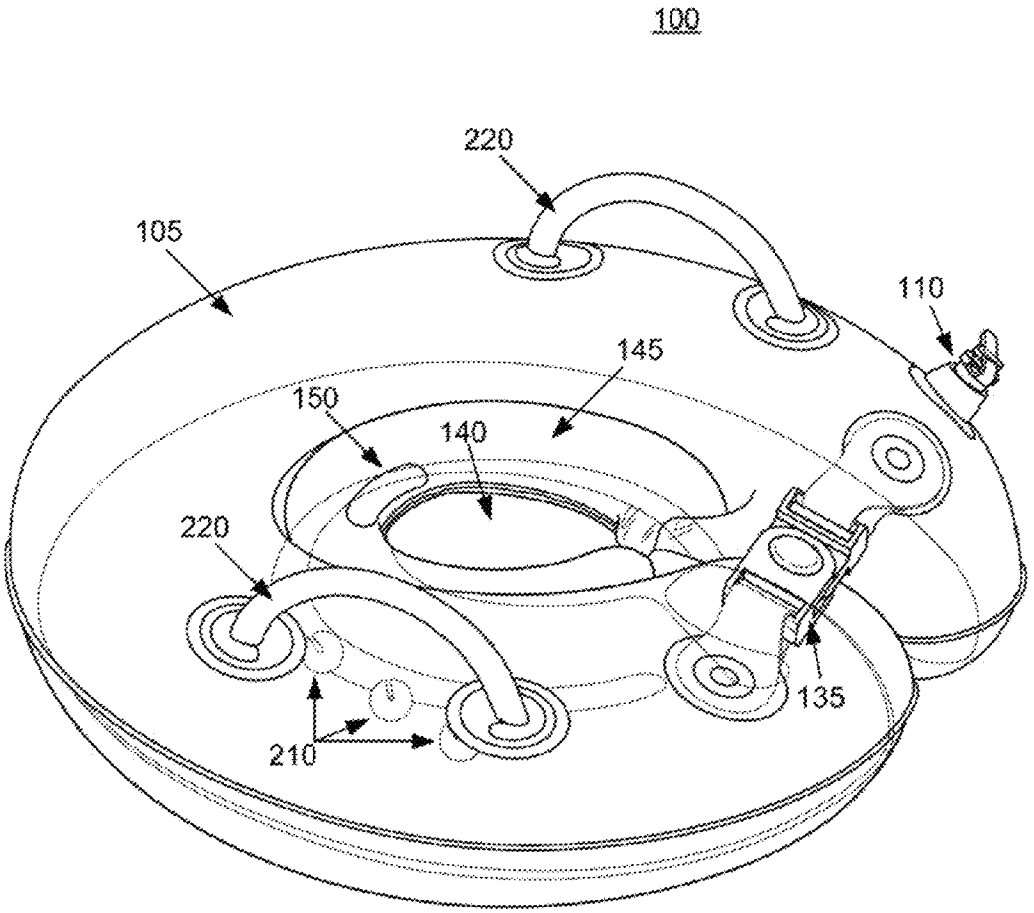
FIG. 2 is an illustrative perspective view of the infant recreational floatation device, where the chamber has been inflated with air, in accordance with some embodiments of the disclosed subject matter.
Figure 7:
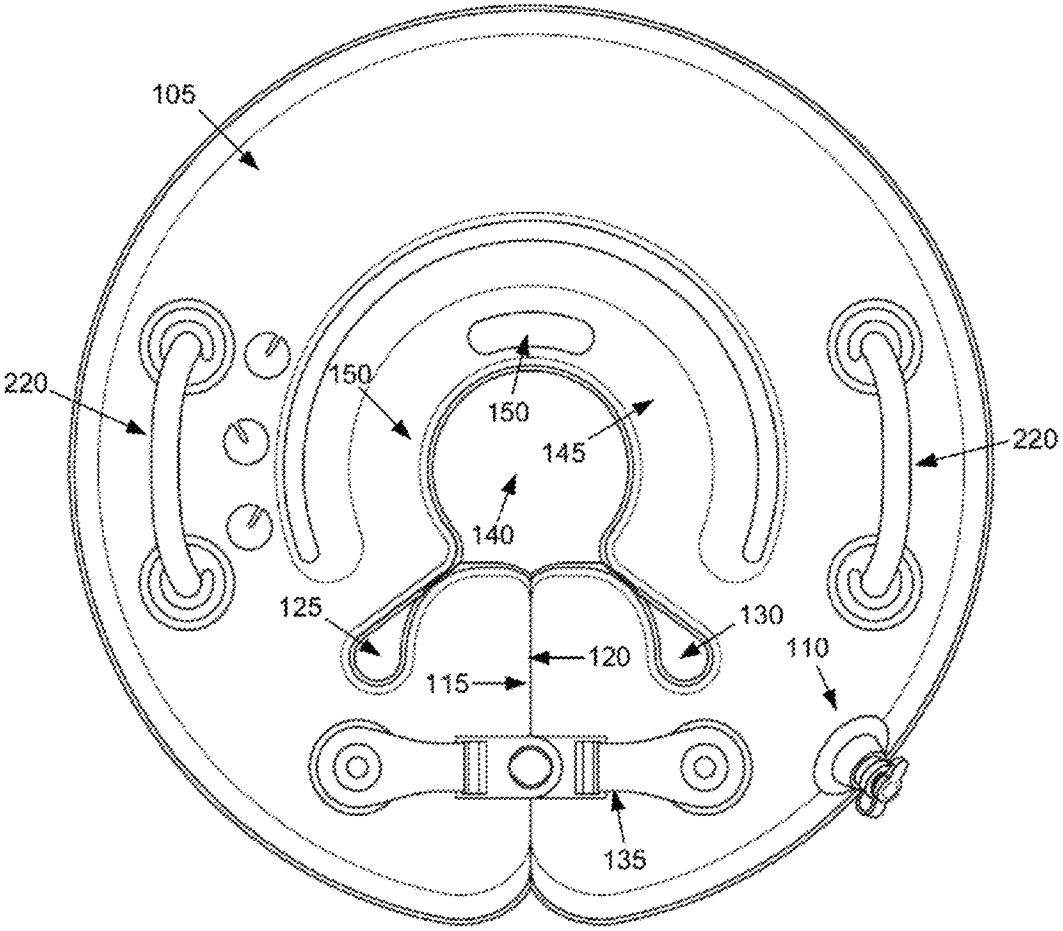
FIG. 7 is an illustrative top plan view of the infant recreational floatation device, where the chamber has been inflated with air, in accordance with some embodiments of the disclosed subject matter.

FIGS. 2 and 7 show a perspective view and a top plan view, respectively, of infant recreational floatation device 100 of FIG. 1 that has been inflated with air. As shown in FIG. 2, upon inflating of chamber 105 through valve 110 and upon securing first end 115 and second end 120 with one or more fasteners 135, infant recreational floatation device 100 is substantially annular-shaped, donut-shaped, ring-shaped, toroid-shaped, etc.

Figure 6:
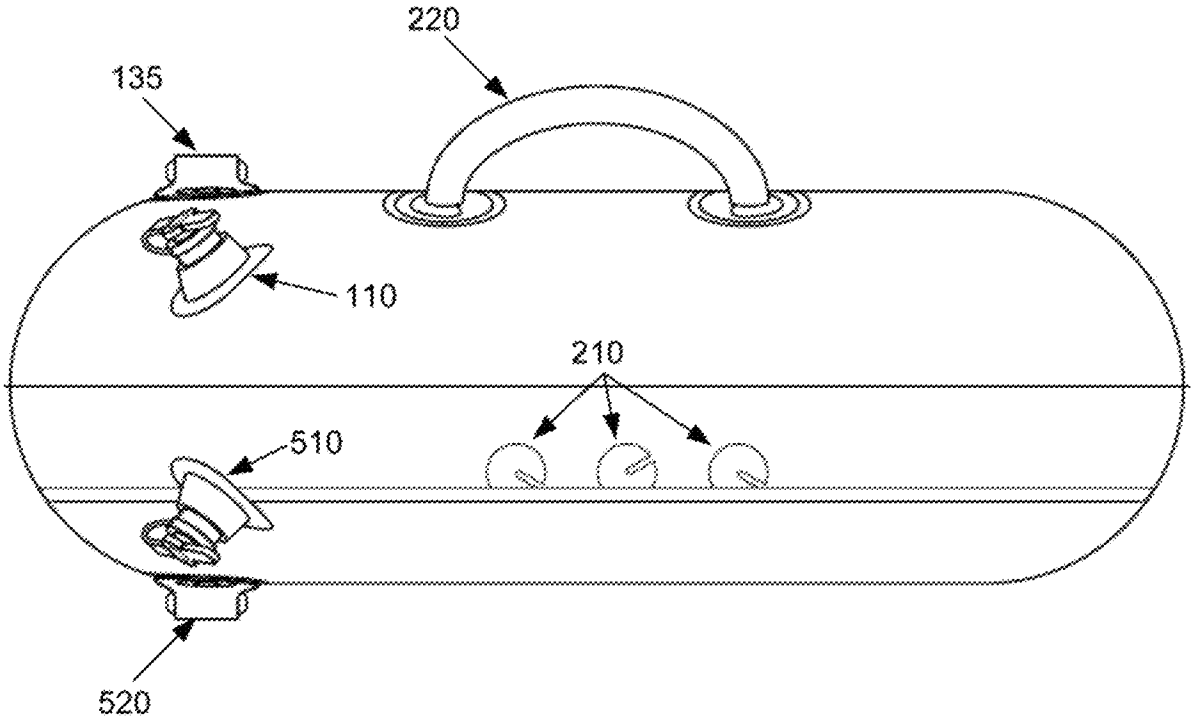
FIG. 6 is an illustrative side view of the infant recreational floatation device, where the chamber has been inflated with air, in accordance with some embodiments of the disclosed subject matter.
Figure 8:
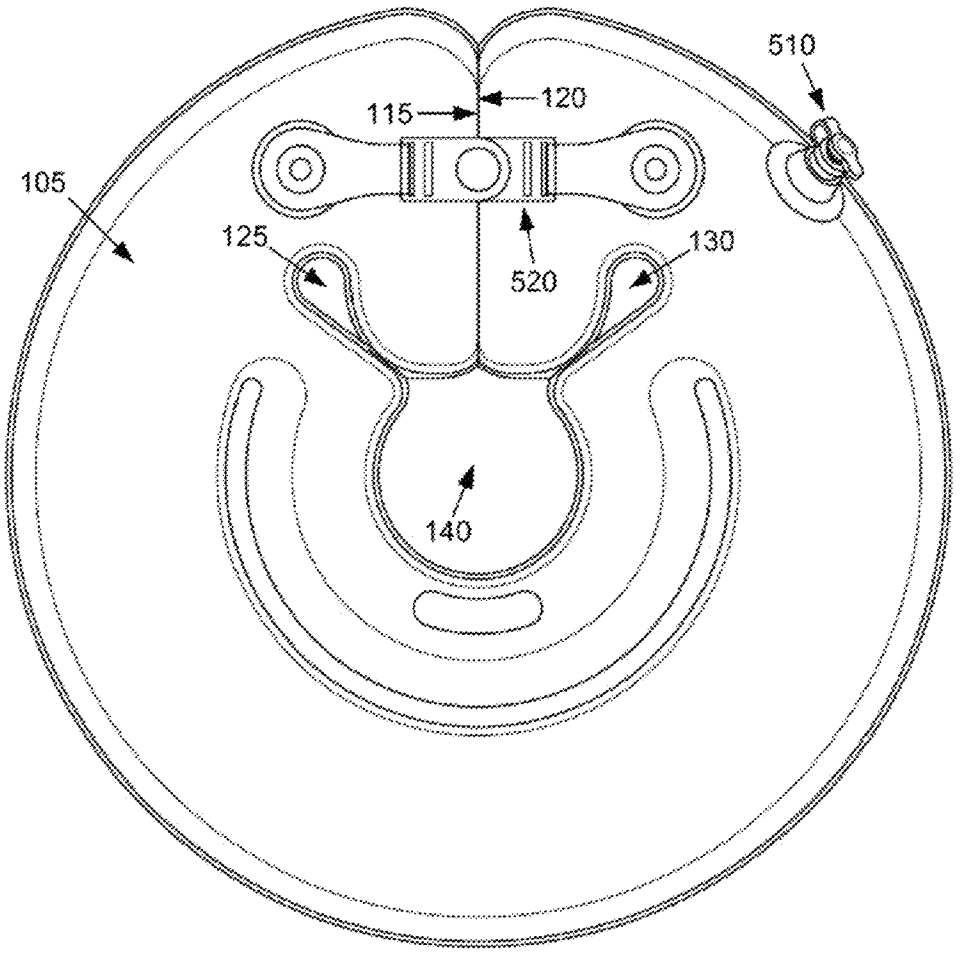
FIG. 8 is an illustrative bottom plan view of the infant recreational floatation device, where the chamber has been inflated with air, in accordance with some embodiments of the disclosed subject matter.

It should be noted that, although FIGS. 1, 2, and 7 show a fastener 135 on the top surface of chamber 105 that can detachably connect opposing ends 115 and 120 of chamber 105, this is merely illustrative. Any suitable number of fasteners can be provided. In one suitable embodiment, multiple fasteners can be provided, where one fastener is placed on the top surface of infant recreational floatation device 100 and another fastener is placed on the bottom surface of infant recreational floatation device 100. For example, FIG. 1 shows that infant recreational floatation device 100 includes fastener 135 on the top surface of the floatation device and FIGS. 5, 6, and 8 show that infant recreational floatation device 100 also includes fastener 520 on the bottom surface of the floatation device.

It should also be noted that any suitable type of fastener can be used. For example, as shown in FIG. 1, fastener 135 includes a snap buckle that can be fastened to connect first end 115 and second end 120 of chamber 105. In another example, fastener 135 can be a fabric hook and loop fastener that adhesively connects first end 115 and second end 120.

It should be further noted that, when using fastener 135 to connect first end 115 and second end 120, first end 115 and second end 120 can be substantially flat. By providing opposing ends 115 and 120 that are substantially flat, infant recreational floatation device 100 can be substantially annular, donut, ring, or toroid in shape.

Referring back to FIG. 2, upon inflating of chamber 105 through valve 110 and upon securing first end 115 and second end 120 with one or more fasteners 135, a central opening 140 can be defined within infant recreational floatation device 100. Referring back to FIG. 1, it should be noted that, when infant recreational floatation device 100 is uninflated or has deflated a substantial amount, central opening 140 can be connected with cut-out portions 125 and 130. However, as shown in FIG. 2, when infant recreational floatation device 100 has been inflated with air, central opening 140 is not substantially connected with cut-out portions 125 and 130. That is, the neck of the infant or any other portion of the infant does not extend into cut-out portions 125 and 130.

Alternatively, as described above, in instances where the neck circumference of the infant being placed in infant recreational floatation device 100 is greater than a particular threshold value (e.g., the circumference of central opening 140), a space between cut-out portions 125 and 130 and central opening 140 can be created when spreading portions of infant recreational floatation device (e.g., first end 115 and second end 120). As such, in some embodiments, when infant recreational floatation device 100 has been inflated with air and portions of infant recreational floatation device have been displaced to accommodate the placement of an infant, central opening 140 can be connected with cut-out portions 125 and 130. Accordingly, in some embodiments, the neck circumference of the infant placed in infant recreational floatation device 100 can determine whether central opening 140 is connected with cut-out portions 125 and 130.

Figure 3:
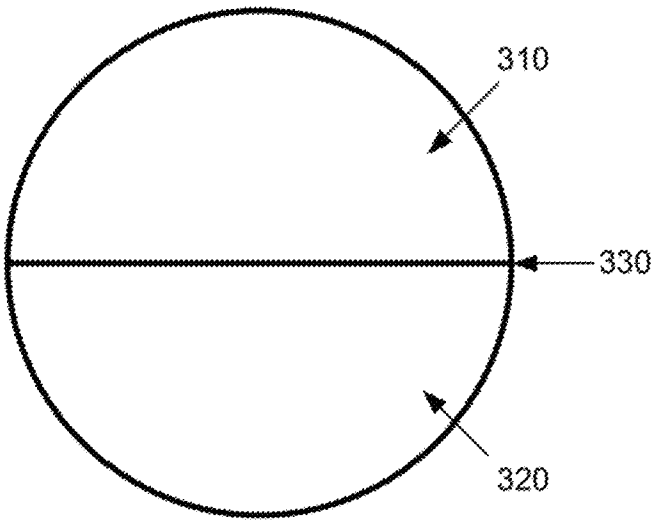
FIG. 3 is an illustrative example of a cross-section of the infant recreational floatation device along a line 300 in accordance with some embodiments of the disclosed subject matter.

In some embodiments, chamber 105 can include multiple chambers. For example, FIG. 3 shows an illustrative cross-section of infant recreational floatation device along line 300. As shown in FIG. 3, chamber 105 can include an upper chamber portion 310 and a lower chamber portion 320. Upper chamber portion 310 and lower chamber portion 320 can be separated by layer 330. For example, as described above, multiple layers of plastic can be joined together using a high frequency plastic welding machine to create chamber 105 having upper chamber portion 310 and lower chamber portion 320 separated by layer 330.

It should be noted that, in some embodiments, upper chamber portion 310 and lower chamber portion 320 are not in fluid communication. As such, valve 110 can be connected to upper chamber portion 310 such that upper chamber portion 310 can be inflated with air via valve 110 and another valve (e.g., valve 510) can be connected to lower chamber portion 320. By providing upper chamber portion 310 and lower chamber portion 320 that are not in fluid communication, buoyancy of infant recreational floatation device 100 can be maintained in response to air leaking out of either upper chamber portion 310 or lower chamber portion 320. This can, for example, create a safety mechanism in the event where air leaks out of either upper chamber portion 310 and lower chamber portion 320.

In some embodiments, infant recreational floatation device 100 can include an inner ring portion. For example, as shown in FIG. 1, inner ring portion 145 extends around the central opening 140 from a location proximate to cut-out portion 125 to a location proximate to cut-out portion 130. As also shown, inner ring portion 145 can be substantially half-toroid-shaped, half-donut-shaped, horseshoe-shaped, or C-shaped. Alternatively, inner ring portion can be any suitable shape, such as a curved cylinder that does not extend to a location proximate to cut-out portions 125 and 130.

It should be noted that inner ring portion 145 does not extend past cut-out portions 125 and 130 such that inner ring portion 145 is not cut through similarly to chamber 105, where opposing ends 115 and 120 are formed from the cut.

It should also be noted that inner ring portion 145 can be in communication with chamber 105. For example, inner ring portion 145 can be in communication with upper chamber portion 310 of chamber 105 (FIG. 3). In another example, inner ring portion 145 can be in communication with lower chamber portion 320 of air chamber 105. In yet another example, inner ring portion can be a portion of chamber 105 that is not in communication with either upper chamber portion 310 or lower chamber portion 320. In such an example, another valve can be connected to inner ring portion 145, which provides the caregiver with an opportunity to inflate or deflate inner ring portion 145 to allow for even greater neck circumference of an infant.

In some embodiments, a chin rest 150 can be formed on inner ring portion 145. For example, as shown in FIG. 1, chin rest 150 can be formed on the center portion of inner ring portion 145. Alternatively, chin rest 150 can be formed on any other suitable portion of infant recreational floatation device 100, such as a portion of chamber 105. This can, for example, align the placement of the infant in the infant recreational floatation device.

Figure 4:
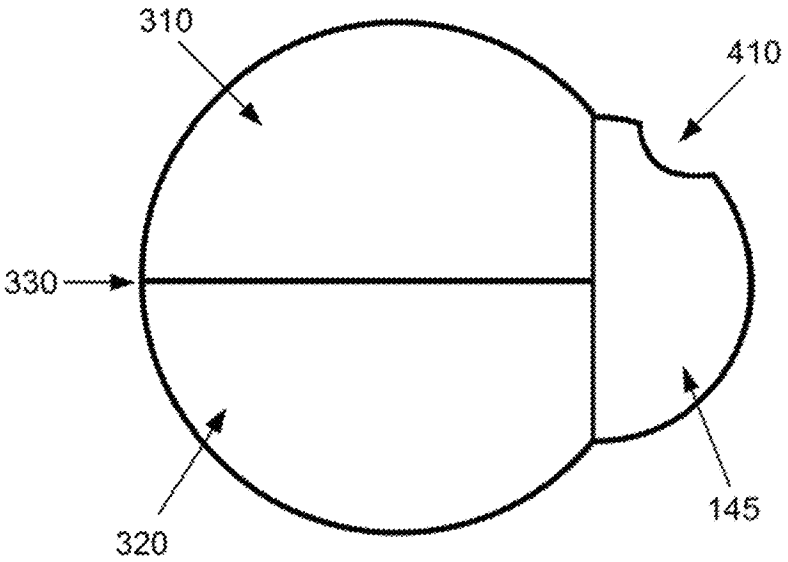
FIG. 4 is an illustrative example of a cross-section of the infant recreational floatation device along a line 400 in accordance with some embodiments of the disclosed subject matter.

An illustrative example of a cross-section of infant recreational floatation device along line 400 is shown in FIG. 4. As shown in FIG. 4, chamber 105 can include an upper chamber portion 310 and a lower chamber portion 320. A portion of upper chamber portion 310 and a portion of lower chamber portion 320 can be adjacent to inner ring portion 145. A recess 410 can be formed in inner region portion to create the chin rest. Although FIG. 4 shows inner ring portion 145 are not being connected to either upper chamber portion 310 and lower chamber portion 320 of chamber 105, inner ring portion 145 can be in fluid communication with chamber 105 (e.g., upper chamber portion 310) at a different location that is not shown in the cross-section of FIG. 4. For example, as shown in FIG. 1, inner ring portion 145 can be connected to chamber 105 in close proximity to cut-out portions 125 and 130.

In some embodiments, infant recreational floatation device 100 can include one or more toys. For example, as shown in FIGS. 2 and 6, multiple colored balls 210 can be placed within chamber 105. In a more particular example, multiple colored balls 210 can be placed within upper chamber portion 310 of chamber 105. These colored balls 210 can move within chamber 105 (e.g., upper chamber portion 310 and inner ring portion 145), for example, as an infant using infant recreational floatation device 100 moves around in a body of water.

In some embodiments, infant recreational floatation device 100 can include one or more handles. For example, as shown in FIG. 2, handles 220 can be placed on the top surface of chamber 105. More particularly, two handles can be placed on the top surface of chamber 105, where one handle is positioned on the left side of infant recreational floatation device 100 and another handle is positioned on the right side of infant recreational floatation device 100.

It should be noted that, although the embodiments described herein generally show a top surface of the infant recreational floatation device that includes handles, a chin rest, and multiple toys within an upper chamber of the infant recreational floatation device, this is merely illustrative. In some embodiments, the infant recreational floatation device can be turned on its opposing side, where the opposing side includes similar or different features—e.g., two handles for controlling the infant recreational floatation device, a chin rest in an alternative position, different toys within the chamber of the infant recreational floatation device, etc.

In some embodiments, infant recreational floatation device 100 can include a detachable seat system. For example, the detachable seat system can include a pair of leg holes in which an infant can insert his or her legs and a seat can be attached to infant recreational floatation device 100 so that the infant is not in danger of falling through infant recreational floatation device 100.

In some embodiments, infant recreational floatation device 100 can include a detachable tether. One end of the detachable tether can be connected to the wrist of a caregiver. The other end of the detachable tether can be attached to any suitable portion of infant recreational floatation device 100. For example, the detachable tether can be connected to one of handles 220 on the top surface of chamber 105. In another example, the detachable tether can be connected to the detachable seat system. In yet another example, detachable tether can be connected around the circumference of infant recreational floatation device 100.

Accordingly, an infant recreational floatation device is provided.

Although the invention has been described and illustrated in the foregoing illustrative embodiments, it is understood that the present disclosure has been made only by way of example, and that numerous changes in the details of implementation of the invention can be made without departing from the spirit and scope of the invention. Features of the disclosed embodiments can be combined and rearranged in various ways.

What is claimed is:

1. A floatation device for an infant, the floatation device comprising:

an inflatable ring having a top surface and a bottom surface, wherein the inflatable ring includes:

an air chamber having an upper chamber portion and a lower chamber portion that are divided by a layer;

a cut through the air chamber of the inflatable ring that forms a first end of the inflatable ring and a second end of the inflatable ring, wherein the first end and the second end of the inflatable ring are displaceable away from each other to insert a neck of the infant into an interior space having a first area;

a plurality of cut-out portions adjacent to the interior space, wherein each of the plurality of cut-out portions extends from the bottom surface of the inflatable ring to the top surface of the inflatable ring and wherein the first end and the second end of the inflatable ring are displaceable away from each other using the plurality of cut-out portions, thereby increasing the area of the interior space to a second area greater than said first area for inserting the neck of the infant; and a plurality of fasteners placed on the top surface and the bottom surface of the inflatable ring that detachably connect the first end and the second end of the inflatable ring.

2. The floatation device of claim 1, wherein, upon inflating the inflatable ring and connecting the first fastener and the second fastener to connect the first end and the second end of the inflatable ring, the flotation ring is substantially toroid-shaped.

3. The floatation device of claim 1, wherein a first cut-out portion of the plurality of cut-out portions is adjacent to the first end of the inflatable ring and a second cut-out portion of the plurality of cut-out portions is adjacent to the second end of the inflatable ring.

4. The floatation device of claim 1, wherein, upon inflating the inflatable ring and connecting the first fastener and the second fastener to connect the first end and the second end of the inflatable ring, each of the plurality of cut-out portions is not connected to the interior space.

5. The floatation device of claim 1, wherein, upon inflating the inflatable ring and displacing the first end or the second end of the inflatable ring into one of the plurality of cut-out portions, each of the plurality of cut-out portions is connected to the interior space based on a neck circumference of the infant.

6. The floatation device of claim 1, wherein the inflatable ring further comprises an inner ring portion that is in communication with the upper chamber portion of the air chamber.

7. The floatation device of claim 6, wherein the inner ring portion is substantially half-toroid-shaped.

8. The floatation device of claim 6, wherein a portion of the inner ring portion is used to form a chin rest for the infant.

9. The floatation device of claim 1, further comprising a plurality of balls placed within the upper chamber portion of the air chamber.

10. The floatation device of claim 1, further comprising a plurality of handles formed on the top surface of the inflatable ring.

11. The floatation device of claim 1, further comprising at least a first valve on the top surface of the inflatable ring connected to the upper chamber portion of the air chamber and at least a second valve on the bottom surface of the inflatable ring connected to the lower chamber portion of the air chamber.

12. The floatation device of claim 1, wherein the upper chamber portion and the lower chamber portion of the air chamber are not in fluid communication.

13. A floatation device comprising:

an inflatable ring having an interior space of a first area formed in a center region of the inflatable ring, wherein the inflatable ring includes:

an air chamber;

a plurality of cut-out portions that are adjacent to the interior space, wherein each of the plurality of cut-out portions extends through the inflatable ring;

a cut through the air chamber of the inflatable ring that forms opposing ends of the inflatable ring; and a plurality of fasteners that detachably connect the opposing ends of the inflatable ring;

wherein the opposing ends of the inflatable ring are displaceable away from each other using the plurality of cut-out portions, thereby increasing the interior space from the first area to a second area.

14. The floatation device of claim 13, wherein each of the opposing ends is substantially flat and where the substantially flat opposing ends are connected to form the inflatable ring having a toroid shape.

15. The floatation device of claim 13, wherein each of the plurality of cut-out portions is adjacent to one of the opposing ends of the inflatable ring.

16. The floatation device of claim 13, wherein the inflatable ring further comprises an inner ring portion that is in communication with the air chamber, wherein the inner ring portion is substantially half-toroid-shaped.

17. The floatation device of claim 16, wherein a chin rest for the infant is formed on a surface of the inner ring portion.

18. A floatation device for an infant, the floatation device comprising:

an inflatable ring having an interior space of a first area formed in a center region of the inflatable ring, wherein the inflatable ring includes:

a toroid-shaped air chamber that includes a cut through a cross-section of the air chamber, wherein the cut forms opposing ends of the toroid-shaped air chamber;

a plurality of cut-out portions that each extend through the inflatable ring, wherein each of the plurality of cut-out portions is adjacent to the interior space and one of the opposing ends of the toroid-shaped air chamber and wherein the opposing ends of the toroid-shaped air chamber are displaceable away from each other using the plurality of cut-out portions, thereby increasing the interior space from the first area to a second area; and a plurality of fasteners that detachably connect the opposing ends of the inflatable ring.

* * * * *